US005431757A

United States Patent [19]

Petterson et al.

[11] Patent Number: 5,431,757

[45] Date of Patent: Jul. 11, 1995

[54] WATER IN OIL EMULSION EXPLOSIVES CONTAINING A NITRATE SALT WITH AN UNTAMPED DENSITY OF 0.30-0.75 G/CM$^3$

[75] Inventors: Bjorn R. Petterson, Oslo; Kjell Hanto, Spikkestad, both of Norway

[73] Assignee: Dyno Industrier A.S, Oslo, Norway

[21] Appl. No.: 197,704

[22] Filed: Feb. 17, 1994

[51] Int. Cl.$^6$ ..... C06R 31/28

[52] U.S. Cl. ..... 149/46; 149/61; 149/109.6

[58] Field of Search ..... 149/46, 61, 6, 109.6

[56] References Cited

U.S. PATENT DOCUMENTS

| | | | |
|---|---|---|---|
| 4,093,478 | 6/1978 | Hurst | 149/2 |
| 4,110,134 | 8/1978 | Wade | 149/2 |
| 4,111,727 | 9/1978 | Clay | 149/2 |
| 4,181,546 | 1/1980 | Clay | 149/21 |
| 4,386,977 | 6/1983 | Ikeda et al. | 149/2 |
| 4,428,784 | 1/1984 | Jessop et al. | 149/2 |
| 4,525,225 | 6/1985 | Cechanski | 149/19.5 |
| 4,555,278 | 11/1985 | Cescow et al. | 149/21 |
| 4,619,721 | 10/1986 | Cescon et al. | 149/21 |
| 5,078,813 | 1/1992 | Tucker et al. | 149/7 |
| 5,240,524 | 8/1993 | Chattopadhyay | 149/46 |

FOREIGN PATENT DOCUMENTS

0256669A3 2/1988 European Pat. Off. .

*Primary Examiner*—Donald P. Walsh
*Assistant Examiner*—Anthony R. Chi
*Attorney, Agent, or Firm*—Wenderoth, Lind & Ponack

[57] ABSTRACT

The invention relates to cap or booster sensitive explosives for application in bulk or cartridge form in boreholes. The oxidizing salt of the explosive is ammonium nitrate, sodium nitrate and/or calcium nitrate having untamped bulk density of 0.3–0.7 g/cm$^3$. The explosive can be a w-i-o emulsion explosive where the discontinuous phase is an aqueous solution of the oxidizing salts and where low density ammonium nitrate comprises 10–80 weight % of the total explosive. ANFO, HANFO and water-gel explosives comprising said oxidizing salts having untamped bulk density of 0.3–0.7 g/cm$^3$ are examples of explosives according to the invention. The above types of explosives are especially suitable in small and medium size boreholes without using sensitizing or density reducing agents.

6 Claims, No Drawings

WATER IN OIL EMULSION EXPLOSIVES CONTAINING A NITRATE SALT WITH AN UNTAMPED DENSITY OF 0.30-0.75 G/CM$^3$

The present invention relates to cap or booster sensitive explosives for application in bulk or cartridge form in boreholes and containing ammonium, sodium and/or calcium nitrate as oxidizing source. More specifically the explosives are w-i-o emulsions, ammonium nitrate fuel oil (ANFO) explosives or heavy ANFO (HANFO) explosives.

In order to attain sufficient sensitivity for the above explosives in such small boreholes it is necessary to apply sensitizing agents. To facilitate detonation glass bubbles, microballoons or gasing agents like sodium nitrite can be added to provide aeration and active sites or "hot spots". Addition of inerts like glass bubbles reduces the energy/volume ratio of the explosive. Another problem is that the glass or gas bubbles may collapse when exposed to inherent pressure during production or application of the explosive. The sensitivity of the explosive will then be lower than expected, which will result in reduced detontation velocity and even lack of detonation.

From U.S. Pat. No. 4,111,727 there is known a two-component w-i-o blasting composition comprising 10–40% by weight of a w-i-o emulsion comprising aqueous solution of oxidizer salts and oil as the continuous phase mixed with a mass of solid particulate oxidizer salt in proportions of 60–90% by weight of the total. To provide the necessary "hot spots" for promoting detonation the emulsion should only partly fill the voids in the structure of the ANFO or particulate AN part of the explosive. For small boreholes this explosive will only have the desired sensitivity for rather limited ratios ANFO/emulsion. From U.S. Pat. No. 4,181,546, a continuation in part of the above U.S. patent, it is obvious that addition of sensitizers such as hollow glass beads and the like will often be necessary for such HANFO explosives, especially when higher water resistance is required.

In EP 0256669 A2 there is described a dry free-flowing ammonium nitrate (AN) explosive composition with high density and capable of generating high explosive velocity. The explosive comprises particulate AN, carbonaceous fuel and a polymer. The AN used is high density AN with an untamped bulk density of 0.85–0.95 g/cm$^3$. It is preferred to use miniprills with a particle size of 0.5–1.7 mm. Such miniprills permit dense particle packing while retaining sufficient air and void spaces between the explosive particles to permit the mixture to function as an explosive. According to this patent description it has been reported that dense, microprilled AN has greater bulk density and a higher detonation velocity than porous low density AN. However, this application is restricted to ANFO type explosives containing polymers and applying AN having very small particle size, i.e. miniprills, if high detonation velocity is desired.

The main object of the present invention was to obtain an explosive being detonable in boreholes without applying expensive sensitizing agents, such as occluded air particles like microspheres, and not having the limitations and disadvantages of known explosives.

The second object was to obtain emulsion or NANFO explosives being detonable in boreholes with diameter <127 mm without applying density reducing agents.

A further object was to obtain explosives detonable in small diameter boreholes where the explosive could be used both in bulk and cartridge form.

The inventors were primarily concerned with improving the sensitivity of emulsion type explosives for small and medium size boreholes and started testing various types of oxidizer salts to be used in the discontinuous aqueous phase of the explosives. One reason for starting the investigation there was the reported limitations of HANFO explosives without occluded air. To avoid such limitations it seemed necessary to investigate the discontinuous phase of the emulsion and its salts. Though porous AN had been reported to be less useful than dense AN, like microprills, the inventors decided to test low density AN. This was also decided against the general opinion that the energy content of the explosive and the detonation velocity would be too low if AN having lower density than the conventional density was applied. Tests ware accordingly started on AN having substantially lower density than conventional porous AN. The tests were performed in steel pipes having diameters varying from 43 mm–64 mm. Tests were also performed under water in 83 mm–103 mm plastic tubes. It was found that when AN had untamped bulk density of 0.7 g/cm$^3$ or lower, the explosive detonated in 43 mm steel pipes and in 103 mm plastic tubes under water. Under corresponding conditions, i.e. without addition of sensitizing agents like microballoons, explosives containing conventional AN having bulk density above 0.7 g/cm$^3$ failed to detonate in 64 mm diameter steel pipes, and resulted in incomplete detonation in 103 mm plastic tubes under water.

Further tests verified the usefulness of low density oxidizers for small diameter boreholes. CN and NaN having densities of 0.7 g/cm$^3$ or below will also be applicable. Mixtures of low density AN, CN and/or NaN can also be used.

The continous hydrocarbon phase and the emulsifier were as in conventional emulsion explosives like those stated as prior art above. Suitable hydrocarbons comprise fuel oils, aromatic hydrocarbons, naptha, paraffin, wax and, vegetable oils. Suitable emulsifiers comprise sorbitan monooleate (SMO) and its derivatives, poly-iso-butylene (PIB) derivatives and poly-iso-butylene-succinic acid (PIBSA) derivatives.

A surprising effect of the new explosive was that it could endure higher static and dynamic pressure than conventional emulsion or HANFO explosives during manufacture and use without losing sensitivity.

The scope of the invention is as defined in the attached claims.

The invention will be further explained in the following non-limiting examples.

EXAMPLE 1

This example shows detonation tests, in steel pipes, of various types of porous AN in different w-i-o emulsion explosives according to the invention. The continuous hydrocarbon phase was a conventional mineral oil and a conventional emulsifier (SMO). All explosives were oxygen balanced. No density reducing agents or sensitizing agent was applied. The results are shown in table 1.

TABLE 1

| Emulsion | AN * | Wt % AN | Density | VOD | Diameter |
|---|---|---|---|---|---|
| A | 0.83 | 30 | 1.40 | Fail | 64 |
| C | 0.74 | 40 | 1.33 | Fail | 43 |
| A | 0.74 | 40 | 1.34 | Det | 43 |
| A | 0.68 | 30 | 1.32 | 2100 | 43 |
| D | 0.68 | 40 | 1.29 | Det | 43 |
| A | 0.57 1) | 30 | 1.30 | 2500 | 43 |
| A | 0.57 1) | 30 | 1.31 | 2300 | 43 |
| A | 0.57 | 30 | 1.29 | 2700 | 43 |
| D | 0.57 1) | 30 | 1.27 | 2700 | 43 |
| C | 0.37 1) | 30 | 1.32 | Det/Fail | 64/43 |

A: Oxidizer solution containing An, NaN, glycol and water
C: Oxidizer solution containing AN, CN, and water
D: Oxidizer solution containing AN and water
*: Untamped bulk density, those marked with 1) is AN mixed with fuel oil to make ANFO As can be seen from table 1, one emulsion (the most sensitive, type A) detonated in 43 mm pipe with AN density of 0.74 or below but failed to detonate even in 64 mm pipe with a conventional AN with density 0.83. A very conventional emulsion explosive (type D) detonated in 43 mm pipe with AN density of 0.68 and lower. The third and least sensitive emulsion (type C) failed to detonate in 43 mm pipe but detonated in 64 mm pipe with the most porous AN in the test.

EXAMPLE 2

This example shows detonation tests under water of the same types of explosives described in example 1, and no density reducing or sensitizing agent was applied. Energy is and VOD was measured in PVC plastic tubes at 10 m depth. The test results are shown in table 2.

TABLE 2

| Emulsion | AN * | % AN | Density | Energy | VOD | Diameter |
|---|---|---|---|---|---|---|
| A | 0.83 | 40 | 1.48 | Fail | Fail | 103 |
| A | 0.74 | 30 | 1.40 | 65 | Fail | 103 |
| A | 0.74 | 30 | 1.42 | 62 | Fail | 83 |
| A | 0.68 | 30 | 1.39 | so | 2500 | 103 |
| D | 0.68 | 40 | 1.35 | 60 | Fail | 83 |
| A | 0.57 1) | 30 | 1.39 | 91 | 2600 | 103 |
| A | 0.57 1) | 30 | 1.36 | 91 | 2300 | 103 |
| A | 0.57 | 30 | 1.25 | 93 | 2600 | 103 |
| D | 0.57 1) | 30 | 1.33 | 96 | 2800 | 103 |
| C | 0.57 1) | 30 | 1.39 | 70 | Fail | 103 |

A: Oxidizer solution containing AN, SN, glycol and water
C: Oxidizer solution containing AN, CN, and water
D: Oxidizer solution containing AN and water
*: Untamped bulk density, those marked with 1) is AN mixed with fuel oil to make ANFO.
Density is measured at 1 bar pressure.

Energy is given as % of theoretical energy.

The example shows that when the density of AN are 0.68 or lower, detonation with high energy is obtained with emulsion type A, and when the density is 0.57 the emulsion type D also detonates with high energy. The least sensitive emulsion (type C) showed incomplete detonation even with AN at density 0.57, but the energy level was higher than type A with higher AN densities, so is reason to assume that all types of emulsions can be used, according to the invention, if the AN density is low enough. The most sensitive emulsion type A with conventional AN of density 0.83 and 0.74 failed to detonate.

By the present invention explosives have been obtained that will detonate by conventional booster in boreholes having diameter <127 mm (5") without applying sensitizing agents like glass beads, microbubbles, gasing agents, etc. This is achieved by using low density oxidizing salts, especially AN having density of 0.3–0.7 g/cm$^3$.

Application of said low density salts is especially useful in emulsion and HANFO explosives.

Application of the low density AN in ANFO explosives also proved to be useful when higher sensitivity and/or lower volume strength were desired.

Water-gel or oil-in-water (o-i-w) explosives comprising AN having untamped bulk density of 0.3–0.7 g/cm$^3$ are also examples of explosives according to the invention.

The above new type of emulsion can be used together with conventional ANFO or ANFO with low density AN to form HANFO explosives being detonable in low diameter boreholes without applying special sensitizing agents.

The explosives according to the invention will have a high energy content due to the unusually high density in the boreholes and the fact that they do not contain any inert additives. The explosives will also endure higher static and dynamic pressure than explosives sensitized with gas bubbles.

The new explosive is most suitable in boreholes having diameters smaller than 127 mm, but can also be used in larger boreholes.

The manufacture of the new explosives will be simplified and their cost will be lower than for similar conventional explosives.

The explosive according to the invention containing low density oxidizing salts is not limited to special formulations of explosives like the known explosives without density reducing agents. The new explosive can be applied both in bulk and cartridge form.

We claim:

1. A cap or booster sensitive w-i-o emulsion explosive for application in boreholes having diameters of less than 127 mm, where the emulsion comprises a continuous phase which is a carbonaceous fuel, and a discontinuous phase which is an aqueous solution of oxidizing salt selected from the group consisting of ammonium nitrate, sodium nitrate, calcium nitrate and a mixture thereof, and where the explosive also comprises 10–80 weight % of ammonium nitrate having an untamped density of 0.3–0.7 g/cm$^3$, based on the total weight of the explosive, with the proviso that the explosive does not contain a sensitizing agent or a density reducing agent.

2. The explosive of claim 1, wherein the carbonaceous fuel is a member selected from the group consisting of fuel oil, aromatic hydrocarbon, naphtha, paraffin, wax and vegetable oil.

3. A cap or booster sensitive explosive or application in boreholes having diameters of less than 127 mm, comprising a w-i-o emulsion explosive having a continuous phase which is a carbonaceous fuel, and an aqueous phase of oxidizing salt selected from the group consisting of ammonium nitrate, sodium nitrate, calcium nitrate and a mixture thereof, and ammonium nitrate fuel oil explosive (ANFO), and where the ANFO part constitutes 10–80 weight % of the total explosive mixture and at least part of its ammonium nitrate has an untamped bulk density of 0.3–0.7 g/cm$^3$, with the proviso that the explosive does not contain a sensitizing agent or a density reducing agent.

4. The explosive of claim 3, wherein the carbonaceous fuel is a member selected from the group consisting of fuel oil, aromatic hydrocarbon, naphtha, paraffin, wax and vegetable oil.

5. A cap or booster sensitive explosive for application in boreholes having diameters of less than 127 mm, obtained by a process which comprises mixing (1) an emulsion which comprises a continuous phase which is a carbonaceous fuel, and a discontinuous phase which is an aqueous solution of oxidizing salt selected from the group consisting of ammonium nitrate, sodium nitrate, calcium nitrate and a mixture thereof, with (2) 10–80 weight % of ammonium nitrate having an untamped density of 0.3–0.7 g/cm$^3$, based on the total weight of the explosive.

6. A cap or booster sensitive explosive for application in boreholes having diameters of less than 127 mm, obtained by a process which comprises mixing (1) a w-i-o emulsion explosive having a continuous phase which is a carbonaceous fuel, and an aqueous phase of oxidizing salt selected from the group consisting of ammonium nitrate, sodium nitrate, calcium nitrate and a mixture thereof, and (2) ammonium nitrate fuel oil explosive (ANFO), and where the ANFO part constitutes 10–80 weight % of the total explosive mixture and at least part of its ammonium nitrate has an untamped bulk density of 0.3–0.7 g/cm$^3$.

* * * * *